US012595652B2

(12) United States Patent
Huber

(10) Patent No.: US 12,595,652 B2
(45) Date of Patent: Apr. 7, 2026

(54) PRECURSORS FOR STABILIZED IMPALING CLIPS, STABILIZED IMPALING CLIPS FORMED THEREFROM, AND METHOD OF MOUNTING AN ACOUSTIC PANEL ONTO A STRUCTURAL COMPONENT

(71) Applicant: Kenneth Huber, Seattle, WA (US)

(72) Inventor: Kenneth Huber, Seattle, WA (US)

( * ) Notice: Subject to any disclaimer, the term of this patent is extended or adjusted under 35 U.S.C. 154(b) by 185 days.

(21) Appl. No.: 18/436,407

(22) Filed: Feb. 8, 2024

(65) Prior Publication Data

US 2024/0287792 A1 Aug. 29, 2024

Related U.S. Application Data

(60) Provisional application No. 63/448,735, filed on Feb. 28, 2023.

(51) Int. Cl.

| | |
|---|---|
| ***E04B 2/00*** | (2006.01) |
| ***E04B 1/38*** | (2006.01) |
| ***E04B 1/86*** | (2006.01) |

(52) U.S. Cl.
CPC ..... *E04B 1/388* (2023.08); *E04B 1/86* (2013.01)

(58) Field of Classification Search
CPC ..... E04B 1/388; E04B 1/86
See application file for complete search history.

(56) References Cited

U.S. PATENT DOCUMENTS

| | | | | |
|---|---|---|---|---|
| 800,655 A | | 10/1905 | Kitsee | |
| 1,146,586 A | | 7/1915 | Maitland | |
| 1,712,493 A | | 5/1929 | Elmendorf | |
| 1,782,695 A | | 11/1930 | Prez | |
| 1,810,597 A | | 6/1931 | Corwin | |
| 1,915,611 A | | 6/1933 | Miller | |
| 1,935,536 A | | 11/1933 | Balduf | |
| 1,935,574 A | | 11/1933 | Munroe et al. | |
| 1,995,173 A | | 3/1935 | Ehle et al. | |
| 2,256,961 A | | 9/1941 | Pearson et al. | |
| 2,282,631 A | | 5/1942 | Winship | |
| 2,284,301 A | | 5/1942 | Rieser | |
| 2,325,766 A | * | 8/1943 | Gisondi | F16B 15/04 411/921 |
| 2,339,841 A | * | 1/1944 | Deuchler | E04F 13/0835 52/363 |
| 2,396,030 A | | 3/1946 | Terry | |
| 2,580,231 A | | 12/1951 | Lamm | |

(Continued)

FOREIGN PATENT DOCUMENTS

WO 8500397 A1 1/1985

*Primary Examiner* — Basil S Katcheves

(74) *Attorney, Agent, or Firm* — Caesar Rivise, PC

(57) ABSTRACT

A precursor to form an impaling clip, and an impaling clip formed therefrom. The impaling clip is configured for mounting an acoustic panel on a structural component, e.g., a wall stud, of a building. The impaling clip includes a base member from which a pair of prongs project upward perpendicular to the plane of the base member. The base member includes at least one hole for receipt of a fastener, e.g., a screw, to fixedly secure the base member of the clip to the structural component. Each prong includes a leg portion terminating in pointed head and outwardly projecting under-cut barbs configured to pierce through the back surface of the panel to lock the prong within the panel so that it is resistant to removal.

23 Claims, 6 Drawing Sheets

(56) References Cited

U.S. PATENT DOCUMENTS 3,011,226 A 12/1961 Menge
3,016,586 A 1/1962 Atkins
3,196,499 A 7/1965 Houvener
3,222,831 A 12/1965 Pritchard
3,417,652 A * 12/1968 Menge ..... E04B 1/49 411/921
3,603,197 A * 9/1971 Wood ..... F16B 15/0046 52/712
4,128,979 A 12/1978 Price
4,194,336 A 3/1980 Weinar
4,235,148 A * 11/1980 Menge ..... F16B 15/0046 52/712
4,292,777 A 10/1981 Story
4,359,849 A * 11/1982 Goeman ..... E04F 13/0801 52/309.4
4,389,190 A 6/1983 Sevink
4,394,808 A 7/1983 Thorsell
4,423,615 A * 1/1984 Moyer ..... F16B 15/0046 72/332
4,458,387 A 7/1984 Pearson
4,471,592 A 9/1984 MacKinnon, Jr. et al.
4,480,416 A 11/1984 Judkins et al.
4,512,130 A 4/1985 Pepin
4,566,241 A 1/1986 Schneller
4,653,241 A 3/1987 Bindi
4,704,835 A 11/1987 Jordan
4,736,917 A 4/1988 Thuresson
4,761,928 A * 8/1988 Pichette ..... E04B 2/56 52/855
5,060,434 A 10/1991 Allison
5,060,441 A * 10/1991 Pichette ..... E04B 1/7666 52/855
5,216,859 A 6/1993 Moreno et al.
5,299,403 A 4/1994 Fentz
5,531,052 A * 7/1996 Agar ..... E04B 2/7453 52/715
5,546,723 A * 8/1996 Jones ..... E04B 1/4157 52/704
5,661,993 A * 9/1997 Black, Jr. ..... B21D 28/34 72/325
6,171,043 B1 * 1/2001 Williams ..... F16B 15/0046 52/712
6,367,216 B1 * 4/2002 Maylon ..... E04F 13/042 52/363
D497,102 S * 10/2004 Kuhn ..... D8/389
7,225,590 B1 * 6/2007 diGirolamo ..... E04B 1/4178 52/379
9,163,411 B2 10/2015 Brady
10,370,846 B1 8/2019 Neuwirt
11,060,278 B2 * 7/2021 Huber ..... E04B 1/86
11,585,085 B2 2/2023 Huber
2008/0245010 A1 10/2008 Pollack
2009/0126302 A1 5/2009 Thomas
2010/0276559 A1 11/2010 Sillik
2020/0256052 A1 * 8/2020 Huber ..... E04B 1/7666
2021/0317655 A1 10/2021 Huber

* cited by examiner

Fig. 3
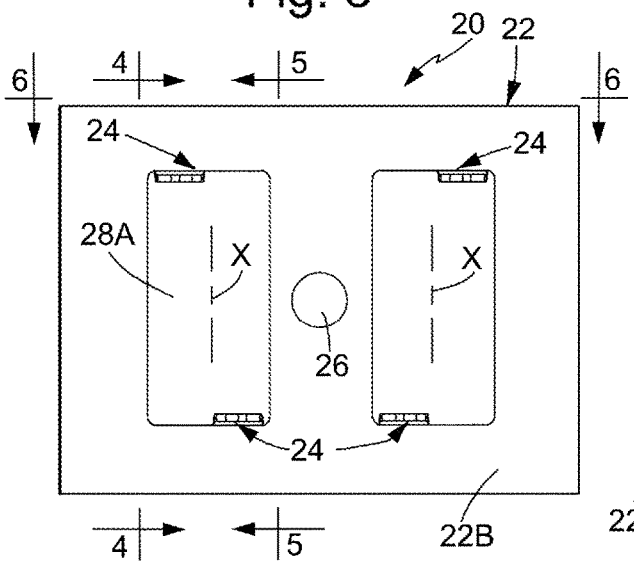
Fig. 4
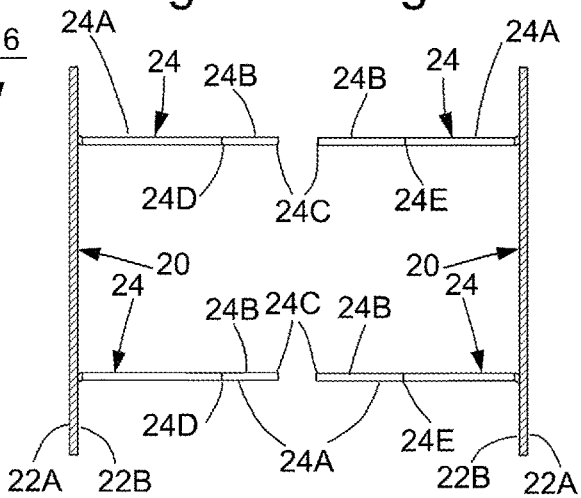
Fig. 5
Fig. 6
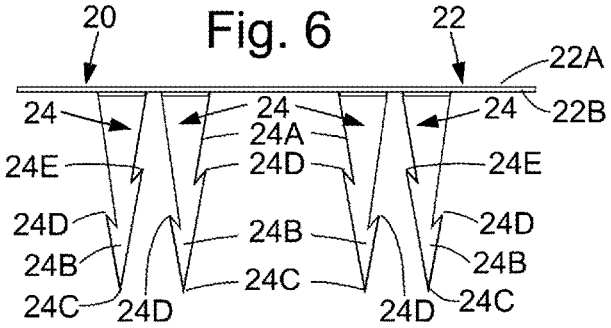
Fig. 7
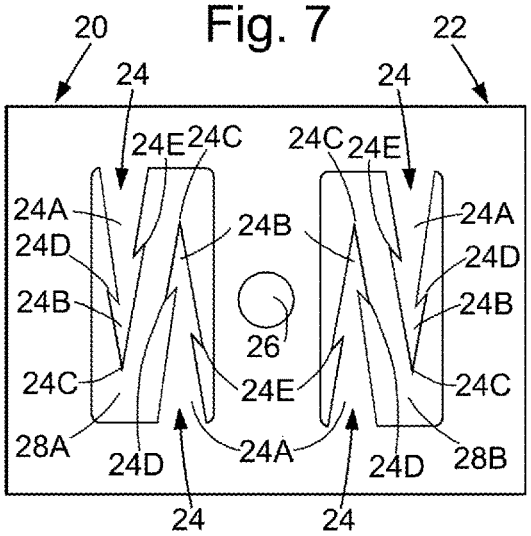

Fig. 7A
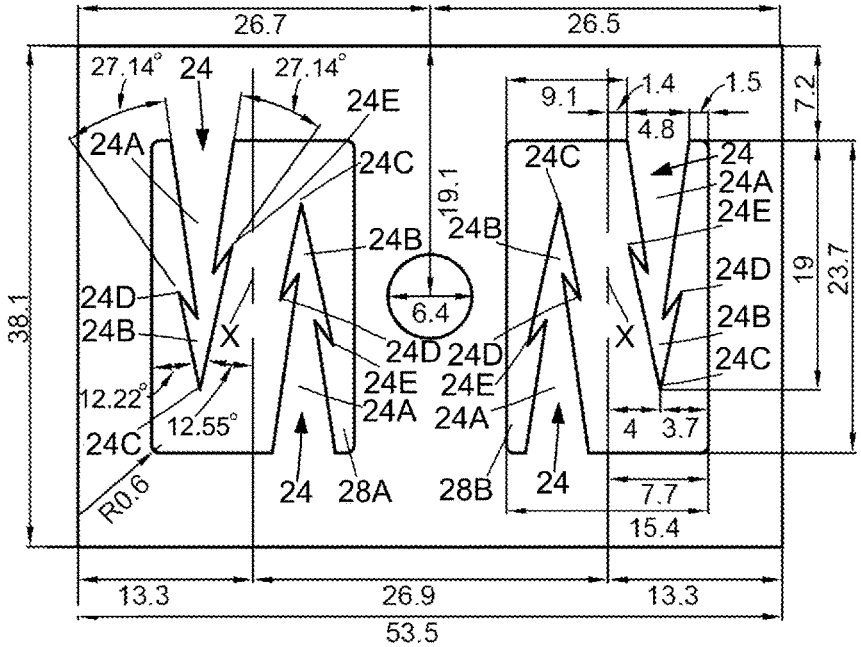
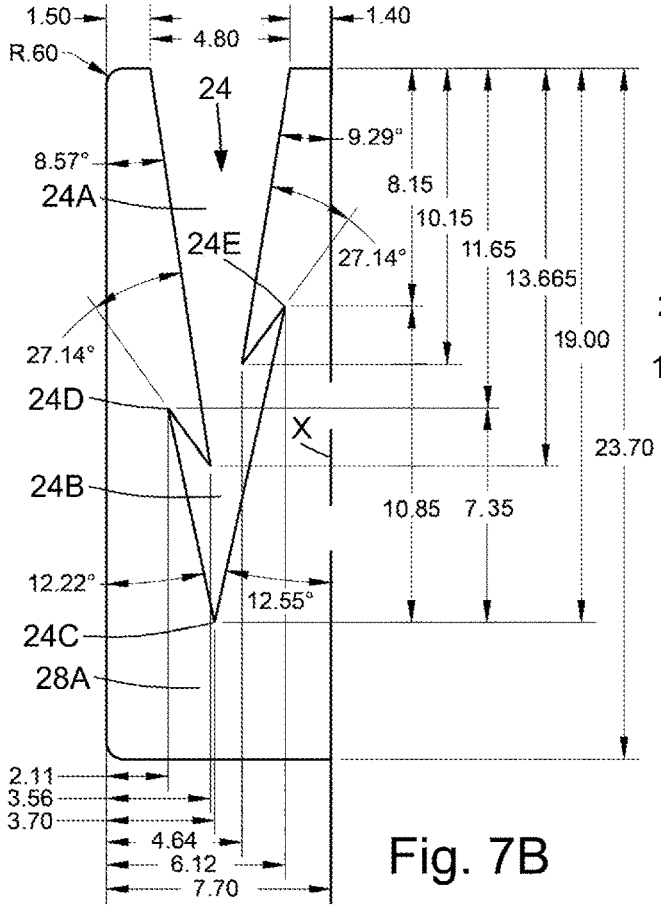
Fig. 7B
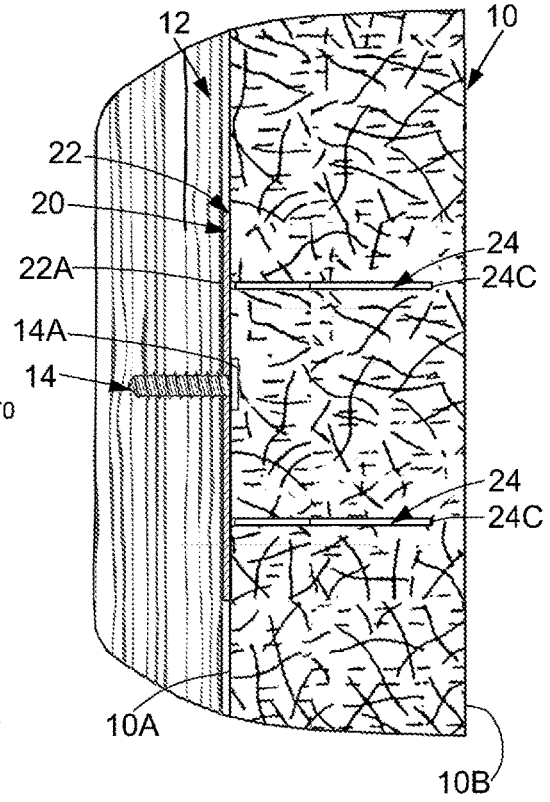
Fig. 8

PRECURSORS FOR STABILIZED IMPALING CLIPS, STABILIZED IMPALING CLIPS FORMED THEREFROM, AND METHOD OF MOUNTING AN ACOUSTIC PANEL ONTO A STRUCTURAL COMPONENT

CROSS-REFERENCE TO RELATED APPLICATIONS

This utility application claims the benefit under 35 U.S.C. § 119(e) of Provisional Application Ser. No. 63/448,735 filed on Feb. 28, 2023 entitled Precursors For Stabilized Impaling Clips, Stabilized Impaling Clips Formed Therefrom, And Method Of Mounting An Acoustic Panel Onto A Structural Component, the entire disclosure of which is specifically incorporated by reference herein.

FIELD OF THE INVENTION

This invention relates generally to mounting clips for structural panels of a building and more particularly to precursors for forming impaling clips, impaling clips formed therefrom, and method for mounting acoustic panels on to structural components of a building using the impaling clips.

SPECIFICATION

Background of the Invention

The patent literature includes various patents directed to clips for mounting wall panels onto portions, e.g., studs, joist, walls, etc. of a building. Such clips include typically include one or more points, tangs, spikes, prongs or other piecing members which are designed to pierce the rear surface of the wall panel to suspend the panel on the structure to which the clip is secured. Examples of such clips are found in the following U.S. Pat. No. 1,935,556 (Balduf); U.S. Pat. No. 2,282,631 (Winship); U.S. Pat. No. 3,222,831 (Pritchard); U.S. Pat. No. 4,128,979 (Price et al.); U.S. Pat. No. 4,394,808 (Thorsell); U.S. Pat. No. 4,566,241 (Schneller); U.S. Pat. No. 5,060,434 (Allison); and U.S. Pat. No. 5,531,052 (Agar).

The mounting of acoustic or sound-absorbing panels in buildings is commonly accomplished by the use of so-called "impaling clips". Such clips typically include plural points, tangs, spikes or prongs that are configured pierce or stick into the rear surface of the acoustic panel to hold the panel in place on the support structure of the building. That support structure may constitute a stud, joist, beam or a wall or ceiling panel itself. In any case, the clip is typically secured to the support structure by means of any suitable type of fastener, e.g., nail, screw, adhesive, etc., depending upon the support structure to which the clip is to be mount to suspend the acoustic panel thereon.

Such impaling clips are commercially available from various sources. For example, ATS Acoustics sells "acoustical insulation impaling clips" to install fiberglass or mineral wool boards to a wall. Each clip measures 2⅛"×1½" and has eight spikes to impale the back of a panel to hold it in place. The impaling spikes on the clip are about ¾" deep. A construction adhesive is recommended to ensure a secure panel installation when using such impaling clips.

Acoustic panels which are constructed of fiberglass or other similar materials can be readily effectively mounted on the impaling clips of the prior art. However, where the acoustic panels are formed of polyester materials, like those available from www.polysorb.com under the trademark PolySorb, prior art impaling clips have been found wanting insofar as the polyester material renders the panels more likely to become disengaged from the piercing points of the impaling clips than fiberglass acoustic panels. Moreover, the material of such polyester acoustic panels renders them somewhat difficult, if not impossible, to impale. Accordingly, the mounting of polyester panels onto structural components of buildings using prior art impaling clips may necessitate the use of adhesives in addition to the clips or alternative methods without clips to ensure that the acoustic panels remain in place.

In my U.S. Pat. No. 11,060,278, whose entire disclosure is incorporated by reference herein for all purposes, there are disclosed precursors for impaling clips and impaling clips constructed from those precursors wherein the impaling clips are particularly suited for mounting polyester acoustic panels onto structural components which overcome many of the disadvantages of the prior art.

While the impaling clips of my aforementioned patent overcome many of the disadvantages of the prior art and are suitable for their intended purposes in some situations once an acoustic panel has been mounted on a structural component of a building using those impaling clips the acoustic panel may have a tendency to twist or pivot somewhat with respect to the structural component.

The subject invention provides a precursor for an impaling clip and an impaling clip produced from that precursor which is resistant to enabling the acoustic panel mounted on it to pivot or twist with respect to the structural component on which the impaling clip is mounted.

BRIEF SUMMARY OF THE INVENTION

One aspect of this invention is an impaling clip for mounting a panel on a support structure. The panel is formed of a material having a rear surface and a front surface. The clip comprises a base, a first prong, a second prong, a third prong, and a fourth prong. The base includes an undersurface configured to be disposed on an outer surface of the support structure and a face surface located opposite the undersurface. The base has a central longitudinal axis. The first prong is in the form of a planar member lying in a first plane projecting outward perpendicularly from the front surface and located on one side of the central longitudinal axis. The second prong is in the form of a planar member lying in a second plane projecting outward perpendicularly from the front surface and located on an opposite side of the central longitudinal axis. The third prong is in the form of a planar member lying in a third plane projecting outward perpendicularly from the front surface and located on one side of the central longitudinal axis. The fourth prong is in the form of a planar member lying in a fourth plane projecting outward perpendicularly from the front surface and located on an opposite side of the central longitudinal axis, Each of the prongs comprises a leg portion, a sharp head portion having a free end in the form of sharp main point, and at least one subsidiary point. The at least one subsidiary point of is in the form of an undercut barb having an edge extending at an acute angle with respect to a side edge of the leg portion of the prong. The sharp main point of the prong is configured for penetration of the rear surface of the panel, whereupon the sharp main point, the at least one subsidiary point and at least a portion of the leg portion enters and is fixedly held within the material of the panel between the rear surface and the front surface thereof, with the at least one subsidiary point resisting extraction of the prong from within the material of the panel In accordance with one preferred aspect of the impaling clip of this invention two of the first, second, third and fourth prongs are in planes parallel to or coincident with each other, and wherein another two of the first, second, third and fourth prongs are in planes parallel to or coincident with each other.

In accordance with another preferred aspect of the impaling clip of this invention the two of the first, second, third and fourth prongs are in planes coincident with each other, wherein the another two of the first, second, third and fourth prongs are in planes coincident with each other. The base comprises a first window and a second window. Each of the windows has a longitudinal central axis, a first edge portion located adjacent one side of the longitudinal central axis, and a second edge portion located adjacent the longitudinal central axis and opposite the first edge portion. The first edge portion is located above the second edge portion, wherein the first prong projects outward perpendicularly from the base at the first edge portion of the first window and the second prong projects outward perpendicularly from the base at the second edge portion of the first window, and wherein the third prong projects outward perpendicularly from the base at the first edge portion of the second window and the fourth prong projects outward perpendicularly from the base at the second edge portion of the second window.

In accordance with another preferred aspect of the impaling clip of this invention each of the prongs comprises first and second subsidiary point. Each of the subsidiary points is in the form of an undercut barb having an edge extending at an acute angle with respect to a respective side edge of the leg portion of the prong.

In accordance with another preferred aspect of the impaling clip of this invention the leg portion of each of the prongs includes a first side edge and a second side edge, and wherein the first subsidiary point is located adjacent the first side edge and the second subsidiary point is located adjacent the second side edge.

In accordance with another preferred aspect of the impaling clip of this invention the first and second subsidiary points are longitudinally offset from each other along an axis extending a length of the prong.

In accordance with another preferred aspect of the impaling clip of this invention the opening is located in the base between the first window and the second window.

In accordance with another preferred aspect of the impaling clip of this invention the first and fourth prongs are in planes parallel to each other, and wherein the second and third prongs are in planes parallel to each other and perpendicular to the planes of the first and fourth prongs.

In accordance with another preferred aspect of the impaling clip of this invention the base comprises a first, second, third and fourth windows. Each of the windows has a longitudinal central axis, a first edge portion located adjacent the longitudinal central axis, and a second edge portion located adjacent the longitudinal central axis and opposite the first edge portion. The first prong projects outward perpendicularly from the base at the first edge portion of the first window. The second prong projects outward perpendicularly from the base at the first edge portion of the second window. The third prong projects outward perpendicularly from the base at the first edge portion of the third window. The fourth prong projects outward perpendicularly from the base at the first edge portion of the fourth window.

In accordance with another preferred aspect of the impaling clip of this invention each of the prongs comprises first and second subsidiary points, each of the subsidiary points is in the form of an undercut barb having an edge extending at an acute angle with respect to a respective side edge of the leg portion of the prong.

In accordance with another preferred aspect of the impaling clip of this invention the leg portion of each of the prongs includes a first side edge and a second side edge, and wherein the first subsidiary point is located adjacent the first side edge and the second subsidiary point is located adjacent the second side edge.

In accordance with another preferred aspect of the impaling clip of this invention the first and second subsidiary points are longitudinally offset from each other along an axis extending a length of the prong.

In accordance with another preferred aspect of the impaling clip of this invention the opening is located in the base between the first window and the second window.

Another aspect of this invention is a precursor for an impaling clip for mounting a panel on a support structure. The panel is formed of a material has a rear surface and a front surface. The precursor comprises a generally planar sheet lying in a plane, an opening or hole extending through the sheet and configured for receipt of a fastener therethrough, and first, second, third and fourth planar prong portions. The first planar prong portion is a portion of the generally planar sheet located at a portion of the base and lying in the plane. The second planar prong portion is a portion of the generally planar sheet located at another portion of the base and lying in the plane. The third planar prong portion is a portion of the generally planar sheet located at another portion of the base and lying in the plane. The fourth planar prong portion is a portion of the generally planar sheet located at another portion of the base and lying in the plane. Each of the planar prong portions comprises a leg portion, a sharp head portion having a free end in the form of sharp main point, and at least one subsidiary point. The at least one subsidiary point is in the form of an undercut barb having an edge extending at an acute angle with respect to a side edge of the leg portion. The planar prong portions are configured to be bent out of the plane to an orientation perpendicular to the plane to form respective first, second, third and fourth prongs, wherein two of the first, second, third and fourth prongs are in planes parallel to or coincident with each other, and wherein another two of the first, second, third and fourth prongs are in planes parallel to or coincident with each other.

In accordance with one preferred aspect of the precursor of this invention each of the planar prong portions comprises first and second subsidiary points. Each of the subsidiary points of the planar prong portions is in the form of an undercut barb has an edge extending at an acute angle with respect to a respective side edge of the leg portion.

In accordance with another preferred aspect of the precursor of this invention the leg portion each of the planar prong portions includes a first side edge and a second side edge, and wherein the first subsidiary point is located adjacent the first side edge and the second subsidiary point is located adjacent the second side edge.

In accordance with another preferred aspect of the precursor of this invention the first and second subsidiary points of the planar prong portions are longitudinally offset from each other along an axis extending a length of the planar prong portion.

In accordance with another preferred aspect of the precursor of this invention the two of the first, second, third and fourth planar prong portions are configured to be bent into planes coincident with each other, wherein the another two of the first, second, third and fourth planar prong portions are configured to be bent into planes coincident with each other. The base comprises a first window and a second window. Each of the windows has a longitudinal central axis, a first edge portion located adjacent one side of the longitudinal central axis, a second edge portion located adjacent the longitudinal central axis and opposite the first edge portion. The first edge portion is located above the second edge portion, wherein the first planar prong portion is located at the first edge portion of the first window, wherein the second planar prong project portion is located at the second edge portion of the first window, wherein the third planar prong portion is located at the first edge portion of the second window, and wherein the second planar prong portion is located at the second edge portion of the second window.

In accordance with another preferred aspect of the precursor of this invention the first and fourth planar prong portions are configured to be bent in planes parallel to each other, and wherein the second and third planar prong portions are configured to be bent into planes parallel to each other and perpendicular to the planes of the first and fourth prong portions.

In accordance with another preferred aspect of the precursor of this invention the base comprises a first, second, third and fourth windows. Each of the windows has a longitudinal central axis, a first edge portion located adjacent the longitudinal central axis, and a second edge portion located adjacent the longitudinal central axis and opposite the first edge portion. The first planar prong portion is located at the first edge portion of the first window. The second planar prong portion is located at the first edge portion of the second window. The third planar prong portion is located at the first edge portion of the third window. The fourth planar prong portion is located at the first edge portion of the fourth window.

Another aspect of this invention is a method of mounting an acoustic panel on a structural component. The acoustic panel has a front surface and a rear surface. The method comprises providing an impaling clip. The impaling clip comprises a base and a first, second, third and fourth prongs. The base includes an undersurface configured to be disposed on an outer surface of the support structure and a front surface located opposite the undersurface. The base has a central longitudinal axis. The first prong is in the form of a planar member lying in a first plane projecting outward perpendicularly from the front surface and located on one side of the central longitudinal axis. The second prong is in the form of a planar member lying in a second plane projecting outward perpendicularly from the front surface and located on an opposite side of the central longitudinal axis. The third prong is in the form of a planar member lying in a third plane projecting outward perpendicularly from the front surface and located on one side of the central longitudinal axis. The fourth prong is in the form of a planar member lying in a fourth plane projecting outward perpendicularly from the front surface and located on an opposite side of the central longitudinal axis. Each of the prongs comprises a leg portion, a sharp head portion has a free end in the form of sharp main point, and at least one subsidiary point. The at least one subsidiary point of is in the form of an undercut barb has an edge extending at an acute angle with respect to a side edge of the leg portion of the prong. The sharp main point of the prong is configured for penetration of the rear surface of the panel. The sharp main point of the prongs is caused to penetrate the rear surface of the panel, whereupon the sharp main point of the prongs, the at least one subsidiary point of the prongs and at least a portion of the leg portion of the prongs enter and are fixedly held within the material of the panel between the rear surface and the front surface thereof, with the at least one subsidiary point of the prongs resisting extraction of the prongs from within the material of the panel.

In accordance with one preferred aspect of the method of this invention, the method additionally comprises disposing the undersurface of the base on an outer surface of the support structure and extending a fastening member through the at least one opening to fixedly secure the base on the support structure with the undersurface in engagement with the outer surface of the support structure.

In accordance with one preferred aspect of the method of this invention, the acoustic panel is formed of a polyester material.

DESCRIPTION OF THE DRAWING

The invention will be described in conjunction with the following drawings in which like reference numerals designate like elements and wherein:

FIG. 3 is a reduced size front elevation view of the impaling clip of FIG. 1;

FIG. 4 is a sectional view taken along line 4-4 of FIG. 3;

FIG. 5 is a sectional view taken along line 5-5 of FIG. 3;

FIG. 6 is a top view of the impaling clip taken along line 6-6 of FIG. 3;

FIG. 7 is a plan view of a precursor panel constructed in accordance with this invention for forming the impaling clip shown in FIG. 1, with that precursor panel including four portions which when bent out of the plane of the precursor panel form the four barbed piercing members or prongs of the impaling clip of FIG. 1;

FIG. 7A is an enlarged plan view of the precursor panel shown in FIG. 7, with some exemplary dimensions of the various features of that precursor panel shown thereon;

FIG. 7B is an enlarged plan view of a portion of the precursor panel of FIG. 7A, namely, the left side portion of the left side window shown in FIG. 7A with additional exemplary dimensions of the various features of the prong forming portion of the precursor panel located within that portion of the window;

FIG. 8 is a sectional view taken along line 8-8 of FIG. 2;

DETAILED DESCRIPTION OF THE PREFERRED EMBODIMENTS OF THE INVENTION

Figure 1:
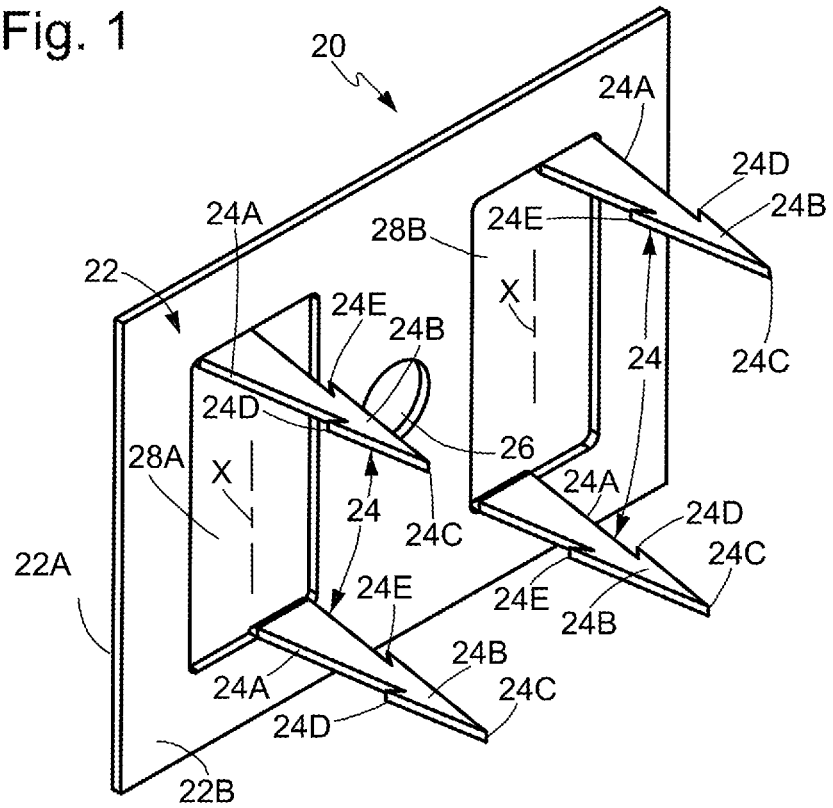
FIG. 1 is an isometric view of one exemplary embodiment of an impaling clip constructed in accordance with this invention, with the impaling clip including two windows, each of which includes two barbed piercing members or prongs projecting perpendicularly to the plane of the window.

Referring now to the various figures of the drawing wherein like reference characters refer to like parts, there is shown in FIG. 1 one exemplary impaling clip 20 constructed in accordance with this invention. The clip 20 and the other impaling clips of this invention are particularly suited for fixedly mounting an acoustic panel 10 that is resistant to impaling (e.g., a polyester acoustic panel) on any type of structural component. In the exemplary embodiment shown in FIG. 8 the clip is shown mounted on a conventional wood wall stud 12. However, that is merely exemplary of various types of structural components on which the impaling clips of this invention can be mounted. Thus, impaling clips constructed in accordance with this invention are suitable for mounting on a metal wall stud, a wood or metal ceiling joist, a concrete wall or ceiling, a gypsum board wall or ceiling, etc.

Impaling clips constructed in accordance with this invention can be used to mount any type of acoustic panel that is resistant to impaling, e.g., having a density of at least approximately 7 lbs/ft$^2$. In the exemplary embodiment of FIGS. 2 and 8 a portion of the acoustic panel 10 is shown. The panel can be of any size and of any thickness. One particularly efficient sound deadening acoustic panel is that available from PolySorb Architectural Audio Absorption Solutions under the model designation Polysorb. That acoustic panel comprises polyester and is available in the following sizes: 4 foot×9 foot, 4 foot×10 foot, 5 foot×9 foot, 5 foot×10 foot or any custom size. It has a thickness of 1 inch, with a core density: 6.5>7.0 ironed or 5.5>6.0 non-ironed, and a noise reduction coefficient of 0.80>0.85. As best seen in FIG. 6 the panel 10 includes an inner surface 10A and an outer surface 10B. Those acoustic panels are approximately 1.0 inch thick.

The impaling clip 20 basically comprises an integral unit formed of any suitable material, e.g., steel. In the preferred embodiment it is stamped or die-cut from a relatively thin, e.g., at least 1 mm thick, planar sheet of metal (e.g., steel) but can be fabricated in other ways and of other materials. In any case the clip 20 basically comprises a base portion 22, at least two, and preferably four piercing members 24, and at least one mounting hole 26. The base portion 22 is generally planar and includes an undersurface 22A and an outer surface 22B. The base portion can be of any shape and size. In the exemplary embodiment shown it is of rectangular shape. The at least one mounting hole 26 is located in the center of the base member and is configured to receive any type of fastener, e.g., a threaded screw 14, therethrough to mount the clip on a structural component, e.g., wall stud 12, of a building.

As mentioned above the impaling clip 20 preferably includes four piercing members 24. Each of the piercing members are preferably of an identical construction and are particularly suited for readily piercing through a hard-to-impale or pierce acoustic panel 10 from the rear surface 10A (FIG. 6) thereof. Once the panel has been pierced the tip or head of the piercing member will be located within that panel, with no portion of it extending through the outer surface 10B of the panel. Moreover, once the piercing member has impaled the acoustic panel and is located therein it will be resistant to displacement due to its shape.

Each of the piercing members 24 is in the form of a sharp elongated prong which projects outward perpendicularly from the plane of the base member 22. In particular, the base member includes two windows 28A and 28B which are identical in shape and are disposed on opposite sides of the opening 26. Two of the four prongs 24 project outward perpendicularly from the windows 28A and the other two of the four prongs 24 project outward perpendicularly from the window 28B. Each of the windows 28A and 28B has a central longitudinal axis X extending vertically. The windows 28A and 28B can be of any shape. In the exemplary embodiment shown they are rectangular, whereupon each window includes a pair of side edges, each of which is linear and extends parallel to the longitudinal central axis X of the window. The window 28A has a first edge portion located adjacent one side of the longitudinal central axis X (e.g., immediately adjacent the upper left-hand corner of the window 28A), and a second edge portion located adjacent the longitudinal central axis X and opposite the first edge portion (e.g., immediately adjacent the lower right-hand corner of the window 28A), whereupon first edge portion is located above the second edge portion. A first prong 24 projects outward perpendicularly from the base at the first edge portion of the window 28A and a second prong 24 projects outward perpendicularly from the base at the second edge portion of the window 28A. In a similar manner, the window 28B has a first edge portion located adjacent one side of the longitudinal central axis X and a second edge portion located adjacent the opposite side of the longitudinal central axis. In this case the first edge portion of window 28B is located immediately adjacent the upper right-hand corner of the window 28B and the second edge portion of window 28B is located immediately adjacent the lower left-hand corner of the window 28B so that the first edge portion of window 28B is located above the second edge portion of window 28B and diametrically opposite it. A first prong 24 projects outward perpendicularly from the base at the first edge portion of the window 28B and a second prong 24 projects outward perpendicularly from the base at the second edge portion of the window 28B.

As should be appreciated by those skilled in the art, and as best seen in FIGS. 3-6, the prong 24 which extends from the upper left-hand corner of the window 28A lies in a common first plane with the plane of the prong 24 which extends from the upper right-hand corner of the window 28B. That common first plane is perpendicular to the plane of the base member 22. In a similar manner the prong 24 which extends from the lower right-hand corner of the window 28A lies in a common second plane with the plane of the prong 24 which extends from the lower left-hand corner of the window 28B. That common second plane is also perpendicular to the plane of the base member 22.

It should be noted that while the windows are shown as being rectangular, they can be of any shape, e.g., a polygon, a circle, an ellipse or any other regular or non-regular shape so long as each includes a first edge portion and a second edge portion which are disposed diametrically opposite each other with respect to a central axis, and with the first edge portion being located above the second edge portion, whereupon each perpendicularly projecting prong 24 will lie in its own respective plane perpendicular to the plane of the base 22 of the impaling clip and the prongs will be laterally offset with respect to each other, i.e., be located on opposite sides of the central longitudinal axis X. Those features are important to ensure that the acoustic panel when mounted on the impaling clip will be stable and resistant to pivoting or twisting with respect to the structural component, e.g., a stud, on which the impaling clip is mounted.

It should also be noted that while the exemplary embodiment 20 makes use of two windows, each including two prongs, that configuration is merely exemplary. Thus, the subject invention contemplates an impaling clip having only a single window, with two prongs projecting perpendicularly therefrom and lying in respective parallel planes perpendicular to the plane of the base, or an impaling clip having more than two windows, with the two prongs of each window projecting perpendicularly from each window and lying in respective parallel planes perpendicular to the plane of the base. In any case, each prong 24 is an elongated member having a longitudinal axis, an elongated leg portion 24A extending along the axis and terminating at a wedge-shaped head portion 24B. The leg portion 24A is somewhat triangular in shape and tapers downward in width from the point at which it projects outward from the base portion 22 at its associated window 28. The wedge-shaped head portion 24B has a free end in the form of a main point 24C.

As mentioned above FIG. 7A is a plan view of the precursor for making the impaling clip 20. That plan view includes the dimensions of the various features of the precursor being shown and measured in millimeters. FIG. 7B is an enlarged plan view of the right-most portion of the window 28A showing the features of that portion of the window to form the right-most prong of that window, with other various dimensions of the features thereof being measured in millimeters. Thus, it can be seen that base member 22 is of a rectangular shape having a width of approximately 53.5 mm, and a height of approximately 38.1 mm. Each window 28A and 28B is rectangular in shape having a height of approximately 23.7 mm and a width of approximately 15.4 mm. Each corner of each window is rounded, with a radius of curvature of 0.6 mm. The width of the leg of each prong 24 where it merges with either the top edge or bottom edge of the window is approximately 4.8 mm, with the length of each prong 24 from its main point 24C to its juncture at the bottom or top of the window is approximately 19 mm. That length is sufficient for securely mounting a 1.0 inch thick acoustic panel on the stud 12.

The main point 24C of the head portion 24B of each prong is very sharp. In particular, as best seen in FIG. 7B the left side edge of the head portion 24B of the left-most prong in window 28A is linear and extends at an angle of approximately 12.22 degrees to the left side edge of that window 28A and also to the central longitudinal axis X. The right side edge of the head portion 24B of the left-most prong in window 28A is also linear and extends at an angle of approximately 12.55 degrees to the central longitudinal axis X of the window 28A. Accordingly, the included angle of the side edges of the head portion 24B forming the main point 24C of the left most prong 24 in the window 28A is approximately 24.77 degrees, with the edges of the material making up the point being very sharp. As such the main point 24C of the prong 24 can readily pierce into the hard-to-pierce material making up the acoustic panel 10.

The wedge-shaped head portion 24B of each prong 24 also includes at least two subsidiary points 24D and 24E. In particular, the subsidiary point 24D is located on the linear left side edge of the head portion 24B of the prong closest to the left side edge of the window 28A as best seen in FIG. 7B. The subsidiary point 24D merges with the adjacent left side edge of the leg portion 24A of that prong to form an undercut barb, similar to that of a fish hook. The included angle of the undercut barb at the subsidiary point 24D is approximately 27.14 degrees. The subsidiary point 24E is located on the opposite side edge of the head portion 24B from the subsidiary point 24D of that prong and merges with the adjacent right side edge of the leg portion 24A to form an undercut barb, also similar to that of a fish hook. The included angle of the undercut barb at the subsidiary point 24E is also approximately 27.14 degrees. The subsidiary point 24E of the left-most prong of the window 28A faces the central longitudinal axis X. The left side edge of the leg portion 24A of the left-most prong 24 extends at an angle of approximately 8.57 degrees to the left side edge of the window 228C. The right side edge of the leg portion 24A of the left-most prong 24 extends at an angle of approximately 9.29 degrees to the central longitudinal axis X.

The barbs at the subsidiary points 24D and 24E are longitudinally off-set from each other measured along an axis parallel to the longitudinal central axis X. In particular, the subsidiary point 24D is closer to the main point 24C measured along an axis parallel to the longitudinal central axis X than the subsidiary point 24E is with respect to the main point. For example, the subsidiary point 24D is offset longitudinally from the main point 24C by approximately 7.35 mm and with the subsidiary point 24E being offset longitudinally from the main point 24C by approximately 10.85 mm. The right most prong 24 in the window 28A shown in FIGS. 7A and 7B is constructed identically to the left most prong in that window, but extends in the opposite direction. In particular, the main point 24C of the right-most prong faces the top edge of the window 28A, whereas the main point 24C of the left-most prong in the window 28A faces the bottom edge of the window 28A. The subsidiary point 24D of the right-most prong in the window 28A faces central longitudinal axis X, with the subsidiary point 24E of that prong facing the right side of that window.

The prongs 24 in the window 28B are constructed identically to the prongs in the window 28A, but are oriented as mirror images of the prongs of the window 28A.

The mounting hole 26 is approximately 6.4 mm in diameter and is located in the center of the base member approximately 19.1 mm from the top and bottom edges of the base member.

As should be appreciated by those skilled in the art, the undercut barbs at the subsidiary points 24D and 24E make extraction of the wedge shaped head portion 24B from the material making up the acoustic panel 10 difficult, in a manner similar to the manner that the barb of a fish hook makes the hook resistant to displacement from the mouth of a fish. Moreover, the longitudinal offset nature of the barbed subsidiary points further reduce the chances of accidental displacement or extraction from the acoustic panel.

Figure 2:
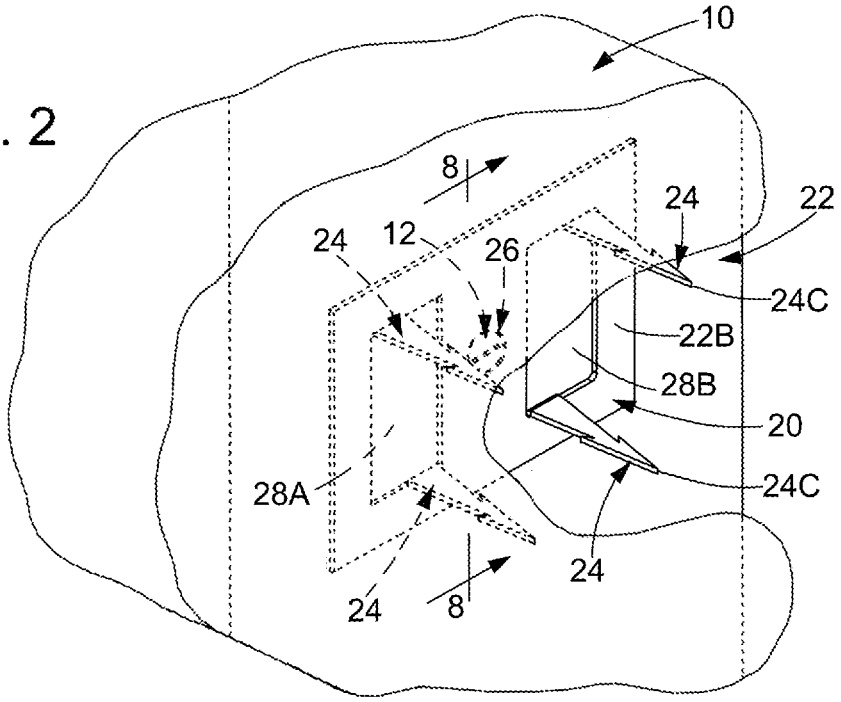
FIG. 2 is an isometric view, partially broken away, showing the impaling clip of FIG. 1 mounted on a structural component, e.g., a conventional wall stud, supporting a conventional polyester acoustic panel thereon.

Use of the impaling clip 20 will now be described with reference to FIGS. 2 and 8. In particular, if it is desired to mount an acoustic panel 10 on vertically extending wall studs 12 all that is required is to fixedly secure a desired number of impaling clips 20 onto the front face 12A of the studs. If the studs are on sixteen inch centers it is preferred to mount the impaling clips 20 on the front face of the studs so that the impaling clips will be separated from one another by a suitable distance given the thickness, size and weight of the acoustic panel to be mounted on those clips. The mounting of the impaling clips on the studs, or any other structural member onto which the acoustic panel is to be mounted, can be accomplished by any suitable fastener. In the exemplary embodiment shown that fastener is a threaded screw 14. In particular, as shown in FIGS. 2 and 8, the clip is mounted on a wood wall stud 12 by means of the screw 14 whose threaded shank is extended through the mounting hole 26 into the stud and with the screw's head 14A is in engagement with the outer surface 22B of the clip's base 22 contiguous with the mounting hole 26.

Once the impaling clips 20 have been fixedly secured to the front face of the studs 12 the prongs 24 of the clips will face outward from those studs. The acoustic panel 10 to be mounted can then be juxtaposed so that its rear surface 10A faces the pointed or free end 24C of the prongs 24. The acoustic panel can then be pushed into engagement with the tips 24C of the prongs, whereupon the arrowhead-like barbed head 24B of the prongs will pierce through the rear surface 10A of the panel 10 and into the interior of the panel and the rear surface 10A of the panel will engage the front surface 22B of the base member 22 like shown in FIGS. 2 and 6. Once that has occurred the barbs 24D and 24E of the prong's head 24B will engage portions of the material making up the panel 10 to prevent the panel from becoming dislodged.

The impaling clip 20 can be made in various ways. One preferred way is by forming it from a precursor in accordance with one aspect of this invention. To that end, the precursor is in the form of a planar panel that can be stamped or die-cut from a relatively thin, e.g., 1 mm, planar sheet of metal, e.g., steel, which is sized and shaped to form the base portion 22 of the impaling clip 20. If desired, the precursor's planar panel can be fabricated in other ways and made of other materials. In any case, the precursor's planar panel is like that shown in FIG. 1, except that the four prongs 24 are located within the openings or windows 28A and 28B in the plane of the panel. Thus, to form the impaling clip 20 from the precursor panel, all that is required is to bend the portions of the panel which will form the prongs 24 out of the plane of the panel so that each such portion is in an orientation perpendicular to the plane of the panel to form the prongs of the impaling clip 20.

As will be appreciated by those skilled in the art, with the prongs 24 constructed like that described above, once they are in place within the acoustic panel 10 the clip 20 is resistant to removal by virtue of the gripping action of the under-cut barbs 24D and 24E, with the off-set feature of those under-cut barbs providing the impaling clip 20 with more holding power than if the two subsidiary points were not offset longitudinally.

It should be noted that the prongs 24 of the impaling clip 20 of this invention are similar in shape to the prongs shown and described in FIGS. 7 and 8 of my aforementioned patent. That is merely exemplary. Thus, the prongs of the impaling clips of this invention can be shaped differently than the prongs 24 specifically described above, providing that the prongs are particularly positioned or located with respect to each other. In this regard, it is clear that in my aforementioned patent where the impaling clip includes two windows, each with a single prong projecting perpendicular from the window, the prongs are laterally aligned, i.e., they lie side-by-side, with the prongs lying in a common plane that is perpendicular to the plane of the base of the impaling clip. As such, in some applications the acoustic panel mounted by those impaling clips may have a tendency to pivot or twist when mounted on the stud or other structural component due to the alignment of the prongs. In contradistinction, the impaling clips of this invention make use of at least two prongs located diametrically with respect to a longitudinal central axis of the clip. Moreover, each prong lies in its own respective plane perpendicular to the plane of the base. Those features tend to reduce, if not eliminate, the tendency that the acoustic panel mounted on the impaling clips will twist or pivot with respect to the structural component on which the impaling clip are mounted.

Figure 9:
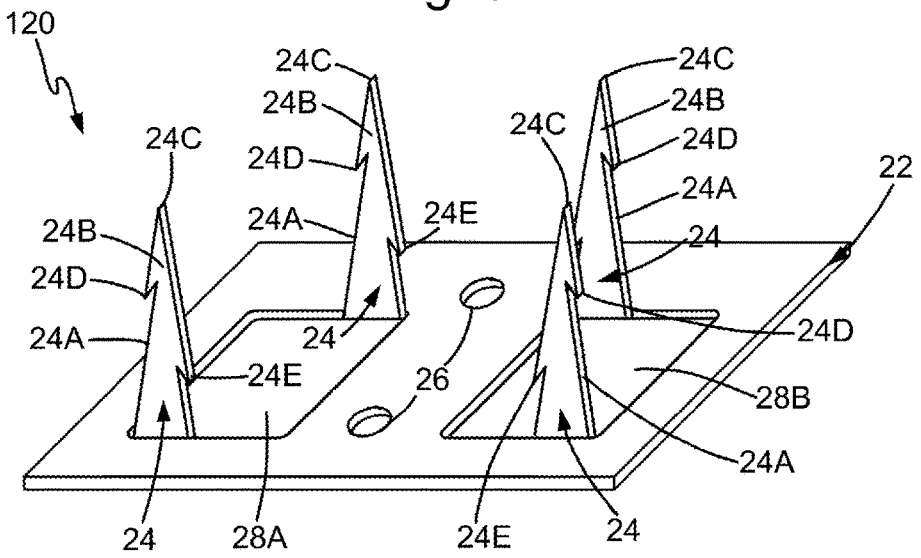
FIG. 9 is an isometric view of an alternative exemplary embodiment of an impaling clip constructed in accordance with this invention.

In FIG. 9 there is shown an alternative exemplary embodiment of an impaling clip 120 constructed in accordance with this invention. The impaling clip 120 is similar in construction to the impaling clip 20, but differs in the dimensions of the various features. In the interest of brevity the common features of the impaling clip 120 will be given the same reference numbers as those of the impaling clip 20, and the structure, function and operation of those features will not be reiterated. Like the impaling clip 20, the impaling clip 120 is stamped or die-cut from a relatively thin, e.g., 1.5 mm thick, planar sheet of metal (e.g., steel), but can be fabricated in other ways and of other materials.

Figure 10:
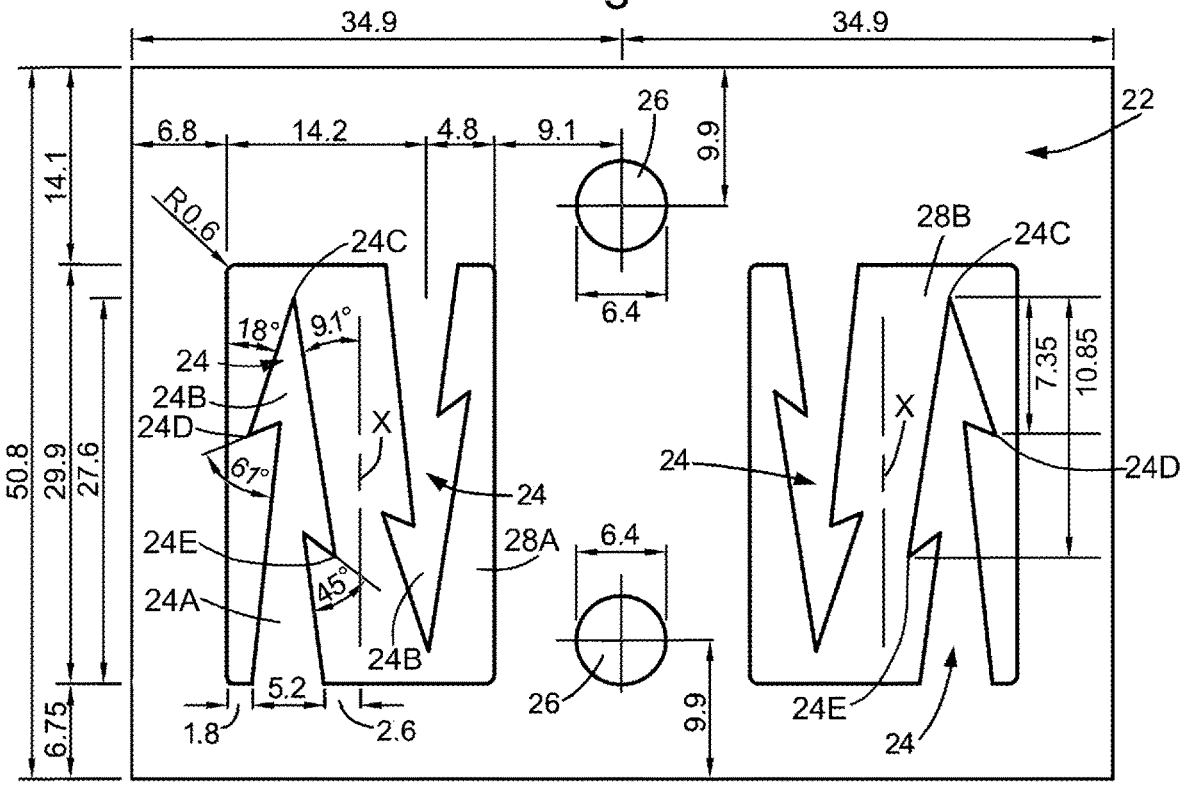
FIG. 10 is an enlarged plan view of a precursor panel constructed in accordance with this invention for forming the impaling clip shown in FIG. 9, with that precursor panel including four portions which when bent out of the plane of the precursor panel form four barbed piercing members or prongs of the impaling clip of FIG. 9, and with exemplary dimensions of the various features of the precursor panel shown thereon.

The impaling clip 120 basically comprises a base member 22, two windows 28A and 28B, four piercing members or prongs 24 (two of which are located in window 28A and two of which are located in window 28B), and two mounting holes 26. The base member 22 is a generally planar member that includes an undersurface 22A and an outer surface 22B and is of rectangular shape having a width of approximately 69.8 mm, and a height of approximately 50.8 mm. As best seen in FIG. 10 each window 28A and 28B is of identical rectangular shape having a height of approximately 29.9 mm and a width of approximately 19 mm. Each corner of each window is rounded, with a radius of curvature of approximately 0.6 mm.

The window 28A includes two prongs 24, with the leg 24A of the left-most of those two prongs merging with the bottom edge of the window and with its main point 24C being directed toward the top edge of that window. The right-most prong 24 of the impaling clip in the window 28A is constructed identically to the left-most prong in that window, but extends in the opposite direction. In particular, the leg 24A of the right-most prong 24 of the window 28A merges with the top edge of the window, with its main point 24C being directed toward the bottom edge of the window 28A. The subsidiary point 24D of the left-most prong in the window 28A faces the left side of that window. The subsidiary point 24E of the right-most prong in the window 28A faces the right side of that window. As clearly shown in FIG. 10, the prongs 24 in the window 28B are constructed identically to the prongs of the window 28A, but are oriented as mirror images of the prongs of the window 28A.

The width of the leg 24A of each prong 24 where it merges with either the top edge or bottom edge of the window is approximately 5.2 mm, with the length of each prong 24 from its main point 24C to its juncture at the bottom or top of the window being approximately 27.6 mm. That length is sufficient for securely mounting a 1.0 inch thick or greater acoustic panel on the stud 12.

The main point 24C of the head portion 24B of each prong of the impaling clip 120 is very sharp. For example, the left-side edge of the head portion 24B of the left-most prong 24 in window 28A is linear and extends at an angle of approximately 18 degrees to the left side edge of that window and also to the central longitudinal axis X. The right side edge of the head portion 24B of the left-most prong in window 28A is also linear and extends at an angle of approximately 9.1 degrees to the central longitudinal axis X of the window 28A. Accordingly, the included angle of the side edges of the head portion 24B forming the main point 24C of the left-most prong 24 in window 28A is approximately 27.1 degrees and the edges of the material making up the main point are very sharp. As such the main point 24C of the prong can readily pierce into the hard-to-pierce material making up the acoustic panel 10.

The wedge-shaped head portion 24B of the left-most prong 24 in the window 28A also includes at least two subsidiary points 24D and 24E. In particular, as best seen in FIG. 10, the subsidiary point 24D is located on the linear left side edge of the head portion 24B of the prong 24 closest to the left side edge of the window 28A. The subsidiary point 24D merges with the adjacent left side edge of the leg portion 24A of that prong to form an undercut barb, similar to that of a fish hook. The included angle of the undercut barb at the subsidiary point 24D is approximately 61 degrees. The subsidiary point 24E is located on the opposite side edge of the head portion 24B from the subsidiary point 24D and merges with the adjacent right side edge of the leg portion 24A to form an undercut barb, also similar to that of a fish hook. The included angle of the undercut barb at the subsidiary point 24E is approximately 45 degrees.

The distances or spacing of the subsidiary points 24D and 24E of the prongs of the impaling clip from various features of the windows in which they are located will be described hereinafter. Before doing that, it should be noted that many of those distances are not specifically identified by dimensions appearing in FIGS. 9 and 10. However, many of those dimensions are shown and specifically identified in FIG. 15. As mentioned above FIG. 15 represents a portion of the precursor panel of still another embodiment 220 of an impaling clip of this invention. Thus, as will be seen, the spacing of the subsidiary points 24D and 24E of the impaling clip 120 from features of that impaling clip's windows is similar to the spacing of the subsidiary points 24D and 24E of the impaling clip 220 from features of its windows.

The subsidiary point 24D of the left-most prong 24 of the impaling clip 120 is located approximately 1.57 mm from the left side edge of the window 28A. The subsidiary point 24E of the left-most prong 24 is located adjacent the central longitudinal axis X and approximately 7.78 mm from the left side edge of the window 28A. The left side edge of the leg portion 24A of the left-most prong 24 extends at an angle of approximately 6.2 degrees to the left side edge of the window 28C. The right side edge of the leg portion 24A of the left-most prong 24 extends at an angle of approximately 7.8 degrees to the central longitudinal axis X. The subsidiary point 24D of the right-most prong 24 of the window 28A is located approximately 1.57 mm from the central longitudinal axis X of the window 28A. The subsidiary point 24E of the right-most prong 24 is located adjacent the right side edge of the window 28A and approximately 7.78 mm from the central longitudinal axis X.

The barbs at the subsidiary points 24D and 24E of the prongs of the impaling clip 120 are also longitudinally off-set from each measured along an axis parallel to the longitudinal central axis X. In particular, the subsidiary point 24D is closer to the main point 24C measured along an axis parallel to the longitudinal central axis X than the subsidiary point 24E is with respect to the main point. In this regard as can be seen in FIG. 10, the right-most prong 24 in the window 28B, which is the mirror image of the left-most prong 24 in the window 28A, shows that the subsidiary point 24D is longitudinally offset from the main point 24C by approximately 7.35 mm measured along an axis parallel to the longitudinal central axis X, whereas the subsidiary point 24E is longitudinally offset from the main point by approximately 10.85 mm measured along that axis.

Each of the two mounting holes 26 is approximately 6.4 mm in diameter. The two mounting holes are located on a centerline 34.9 mm from each side edge of the base member. The uppermost of the two holes 26 is approximately 9.9 mm from the top edge of the base member, whereas the lowermost of the two holes 26 is approximately 9.9 mm from the bottom edge of the base member. Each mounting hole 26 is configured to receive any type of fastener, e.g., a threaded screw 14, therethrough to mount the clip on a structural component, e.g., wall stud 12, of a building.

The impaling clip 120 of FIG. 9 can be formed from the precursor shown in FIG. 10 in a similar manner as described above with respect to the impaling clip 20. Once formed the impaling clip 120, has a prong 24 which projects outward perpendicularly from the base member 22 at an edge portion located at the lower right-hand corner of the window 28A and another prong 24 which projects outward perpendicularly from the base member at another edge portion located in the upper left-hand corner of the window 28A. In a similar manner, the impaling clip 120 includes another prong 24 which projects outward perpendicularly from the base member at an edge portion located at the lower right-hand corner of the window 28B and another prong 24 which projects outward perpendicularly from the base member at an edge portion located in the upper left-hand corner of the window 28A. The prong 24 which extends from the lower left-hand corner of the window 28A lies in a common first plane with the plane of the prong 24 which extends from the lower right-hand corner of the window 28B. That common first plane is perpendicular to the plane of the base member 22. In a similar manner the prong 24 which extends from the upper right-hand corner of the window 28A lies in a common second plane with the plane of the prong 24 which extends from the upper left-hand corner of the window 28B. That common second plane is also perpendicular to the plane of the base member 22.

Figure 11:
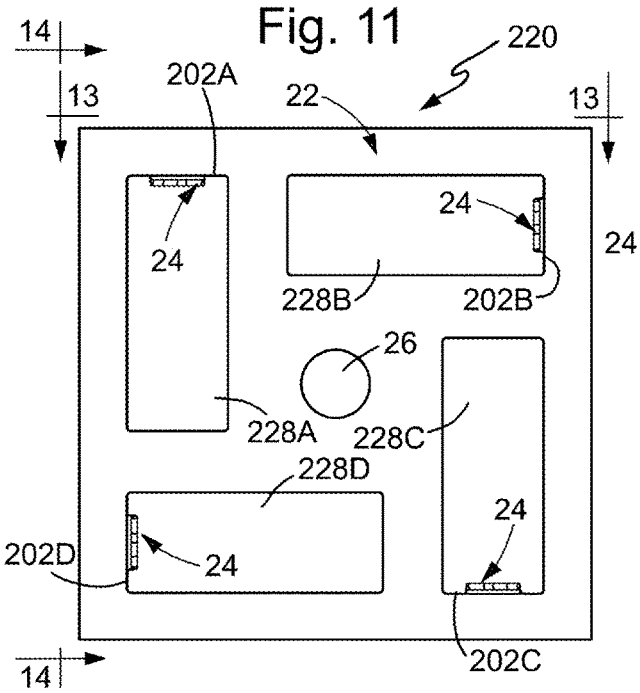
FIG. 11 is a front elevational view of still another exemplary embodiment of an impaling clip constructed in accordance with this invention.
Figure 12:
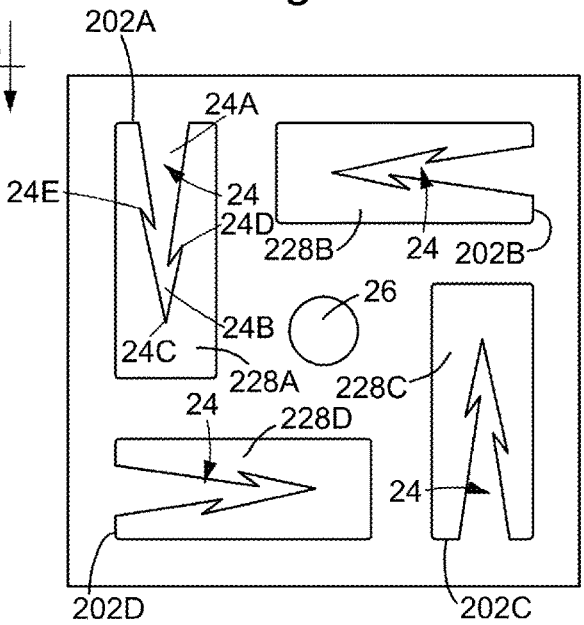
FIG. 12 is a front elevation view of an alternative precursor panel constructed in accordance with this invention for forming the impaling clip shown in FIG. 11, with that precursor panel including four windows each of which includes a portion which when bent out of the plane of the precursor panel form a respective barbed piercing member or prong of the impaling clip of FIG. 11.
Figure 13:
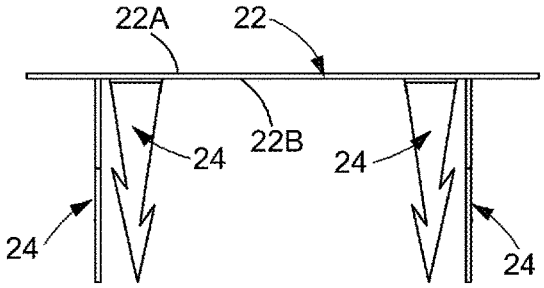
FIG. 13 is a top view of the impaling clip of FIG. 11 taken along line 13-13 of FIG. 11.
Figure 14:
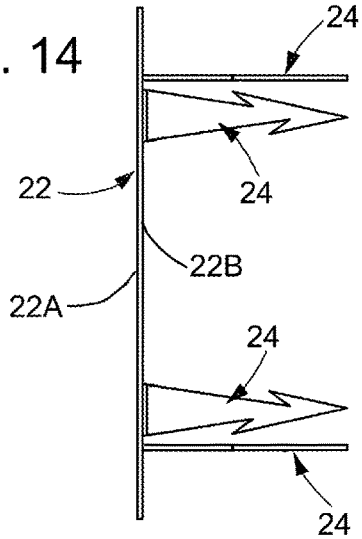
FIG. 14 is a side view of the impaling clip of FIG. 11 taken along line 14-14 of FIG. 11.
Figure 15:
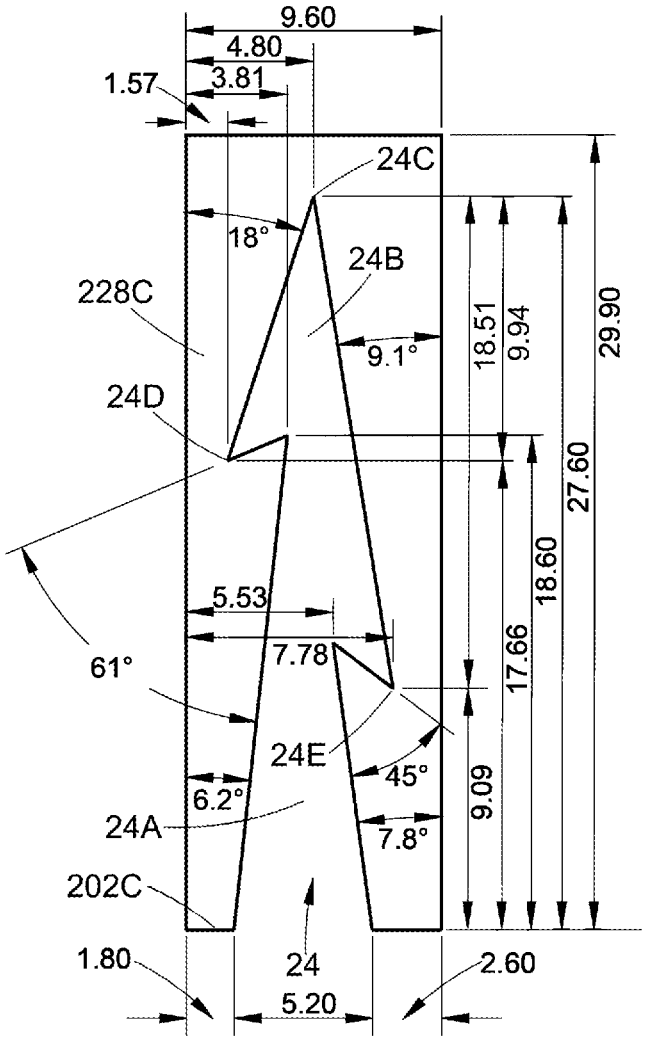
FIG. 15 is an enlarged plan view of one of the four windows of the precursor panel shown in FIG. 12, i.e., the window adjacent the lower right corner of the precursor panel, which produces its barbed piercing member or prong when bent out of the plane of the precursor panel.

Turning now to FIGS. 11-15 there is shown another exemplary embodiment of an impaling clip 220 and a precursor therefor constructed in accordance with this invention. In particular, FIGS. 11, 13 and 14 show the impaling clip 220, with FIGS. 12 and 15 showing the precursor panel and an enlarged portion of it, respectively. The impaling clip 220 is similar in construction to the impaling clips 20 and 120 insofar as it includes a base member from which four outwardly projecting prongs extend. However, unlike the impaling clips 20 and 120 the impaling clip 220 includes four windows (to be described shortly), with each window bearing only a single prong projecting therefrom. Moreover, unlike the impaling clips 20 and 120 wherein two of the four prongs lie in a first common plane perpendicular to the plane of the base member and the other two of the prongs lie in a second common plane perpendicular to the plane of the base member, but parallel to the first plane, none of the prongs of the base member 120 lie in a common plane. Instead, a first two of the prongs of the impaling clip 120 lie in respective planes that are parallel to (but not coincident with) each other and are perpendicular to the plane of the base member. The other or second two of the prongs of the impaling clip 220 lie in respective planes that are perpendicular to (but not coincident with) the planes of the base member and are also perpendicular to the planes of the first two of the prongs.

The details of the construction of the impaling clip 220 will now be discussed. In the interest of brevity the common features of the impaling clip 220 with the impaling clips 20 and 120 will be given the same reference numbers and the details of their construction, function and operation will not be reiterated.

As can be seen in FIG. 11 the impaling clip 220 includes a square shaped base member 22 having four windows 228A, 228B, 228C and 228D located therein. Each window includes a single prong 24 projecting perpendicularly outward therefrom. The prongs 24 of the impaling clip 220 a preferably constructed similarly to the prongs of the impaling clip 120, but may be constructed similarly to the prongs of the impaling clip 20 or any other impaling clip constructed in accordance with this invention. In any case, all of the prongs are of identical construction to one another.

Each window includes an outside edge portion from which a respective prong 24 projects. In particular, the window 228A is located adjacent the upper left-hand corner of the base member 22. The window 228A includes an outside edge 202A which extends parallel to the top edge of the base member. The window 228B is located adjacent the upper right-hand corner of the base member 22. The window 228B includes an outside edge 202B which extends parallel to the right-side edge of the base member 22. The window 228C is located adjacent the lower right-hand corner of the base member 22. The window 228C includes an outside edge 202C which extends parallel to the bottom edge of the base member. The window 228D is located adjacent the lower left-hand corner of the base member 22. The window 228D includes an outside edge 202D which extends parallel to the left side edge of the base member.

Turning now to FIG. 12, wherein the precursor of the impaling clip 120 is shown, it can be seen that the base member 22 of the impaling clip 120 is of a square shape having a length and width of approximately 53.5 mm. Each window 228A, 228B, 228C and 228D is rectangular in shape having a major (long) length of approximately 29.90 mm and a minor (short) length of approximately 9.60 mm. Each corner of each window 228A, 228B, 228C and 228D is rounded, with a small radius of curvature of e.g., 0.6 mm.

FIG. 15 illustrates window 228C of the precursor panel shown in FIG. 12, with its prong 24 located therein, and wherein exemplary dimensions of various features of the window and prong are set forth. As mentioned previously the prongs 24 of the windows 228A, 228B, 228C and 228D are identical in construction to one another and are constructed like the prongs 24 of the impaling clip 120. In particular, the width of the leg 24A of each prong 24 where it merges with the outside edge 202A, 202B, 202C, 202D of its respective window 228A, 228B, 228C and 228D is approximately 5.20 mm, with the length of each prong 24 from its main point 24C to its juncture of that particular outside edge being approximately 27.60 mm. That length is sufficient for securely mounting a 1.0 inch thick acoustic panel on the stud 12. The main point 24C of the head portion 24B of each prong is very sharp. In particular, the left side edge of the head portion 24B of the prong 24 in window 228C is linear and extends at an angle of approximately 18 degrees to the left side edge of that window. The right side edge of the head portion 24B of that prong is also linear and extends at an angle of approximately 9.1 degrees to the right side edge of that window. Accordingly, the included angle of the side edges of the head portion 24B forming the main point 24C of the prong 24 in the window 228A is approximately 27.1 degrees and the edges of the material making up the point are very sharp. As such the main point 24C of the prong 24 can readily pierce into the hard-to-pierce material making up the acoustic panel 10.

The wedge-shaped head portion 24B of each prong 24 also includes at least two subsidiary points 24D and 24E. In particular, the subsidiary point 24D is located on the linear left side edge of the head portion 24B adjacent to the left side edge of the window 228C. The subsidiary point 24D merges with the adjacent left side edge of the leg portion 24A of that prong to form an undercut barb, similar to that of a fish hook. The included angle of the undercut barb at the subsidiary point 24D is approximately 61 degrees. The subsidiary point 24E is located on the opposite side edge (i.e., the right side edge) of the head portion 24B from the subsidiary point 24D and merges with the adjacent right side edge of the leg portion 24A to form an undercut barb, also similar to that of a fish hook. The included angle of the undercut barb at the subsidiary point 24E is approximately 45 degrees. The left side edge of the leg portion 24A of the prong 24 extends at an angle of approximately 6.2 degrees to the left side edge of the window 228C. The right side edge of the leg portion 24A of the prong 24 extends at an angle of approximately 7.8 degrees to the left side edge of the window 228C. The point at which the left side edge of the leg portion 24A merges with the outside edge 202C of the window 228C is approximately 1.80 mm from the left side edge of that window. The point at which the right side edge of the leg portion 24A merges with the outside edge 202C of the window 228C is approximately 2.60 mm from the right side edge of that window. The main point 24C is located midway between the left and right side edges of the window 228C, i.e., 4.80 mm from either side edge. The subsidiary point 24D is located approximately 1.57 mm from the left side edge of the window 228C. The subsidiary point 24E is located approximately 7.78 mm from the left side edge of the window 228C. The undercut portion of the prong at the subsidiary point 24D is approximately 3.81 mm from the left side edge of the window 228C. The undercut portion of the prong at the subsidiary point 24E is approximately 5.53 mm from the left side edge of the window 228C.

The barbs at the subsidiary points 24D and 24E are longitudinally off-set from each other measured along the major length of the window. In particular, the subsidiary point 24D is closer to the main point 24C measured along an axis parallel to the major length of the window 228A than the subsidiary point 24E is with respect to the main point. For example, the subsidiary point 24D is offset longitudinally from the main point 24C by approximately 9.94 mm (27.60 mm minus 17.66 mm). The subsidiary point 24E is offset longitudinally from the main point 24C by approximately 18.51 mm (27.60 mm minus 9.09 mm).

As best seen in FIG. 12 the main point 24C of the prong 24 in the window 228A faces away from the outside edge 202A of the window 228A, and thus faces away from the top edge of the precursor panel. The main point 24C of the prong 24 in the window 228B faces away from the outside edge 202B of the window 228B, and thus faces away from the right side edge of the precursor panel. The main point 24C of the prong 24 in the window 228C faces away from the outside edge 202C of the window 228C, and thus faces away from the bottom edge of the precursor panel. The main point 24C of the prong 24 in the window 228D faces away from the outside edge 202D of the window 228D, and thus faces away from the left side edge of the precursor panel.

The mounting hole 26 is approximately 6.4 mm in diameter and is located at the center of the base member 22.

The impaling clip 220 can be formed from the precursor shown in FIG. 12, by bending each of the prong portions out of the plane of the base member in a similar manner to the manner that the impaling clips 20 and 120 are formed from their respective precursors. Once formed the impaling clip 220 will have each of its prongs lying in a respective plane perpendicular to the plane of the base member, but with none of the planes of the prongs being coincident. Thus, as can be seen in FIGS. 11, 13, and 14, the prong 24 projecting perpendicularly out of the window 228A will lie in a horizontal plane adjacent the top edge of the base member, while the prong 24 projecting out of the window 228C will lie in a horizontal plane adjacent the bottom edge of the base member. Thus, while the planes of those two prongs are horizontal and parallel to each other and perpendicular to the plane of the base member, they are not coincident. In a similar manner, the prong 24 projecting perpendicularly out of the window 228B will lie in a vertical plane adjacent the right side edge of the base member, while the prong 24 projecting out of the window 228D will lie in a vertical plane adjacent the left side edge of the base member. Thus, while the planes of those two prongs are vertical and parallel to each other and perpendicular to the plane of the base member, they are not coincident.

Once the impaling clip 220 is formed from the precursor it can be used in a similar manner to that described with respect to the impaling clips 20 and 120.

With the subject invention wherein the clip's prongs are located with respect to each other as described above, the shape of the prongs can either be the same as that of the prongs 24 particularly described herein or can be of a different shape and size so long as they are constructed in accordance with the teachings of this application or of my aforementioned patent or some variation thereof. That said, it is preferred that each prong include two undercut barbs, each of which is located at a different position along the length of the prong. By so doing each barb of the prong will "grab" the fibers of the acoustic panel at a different position to provide enhanced gripping power. Moreover, the use of longitudinally off-set barbs offers the possibility of the off-set barbs grabbing more fibers at different locations in the core of the material making up the acoustic panel. Put another way, with two barbs at one longitudinal position, but laterally off-set, as the prong's pointed head penetrates the acoustic panel, the fibers of the acoustic panel at the point of penetration will be separated by the two laterally off-set barbs since they will be at the same longitudinal position on the longitudinal axis of the prong, whereas the longitudinally off-set barbs of the impaling clip 20 will grab the fibers of the acoustic panel at different levels within the panel to provide a better grab of those fibers and hence better securement of the panel to the impaling clip. Moreover, by virtue of the fact that the prongs themselves project perpendicularly from the base of the clip at diametrically located positions with respect to the longitudinal central axis of the clip renders the clip a more stable mount for the panel since the panel, when mounted on the clip will be more resistant to twisting or pivoting than longitudinally aligned prongs of my aforementioned patent.

Notwithstanding the forgoing, it must be pointed out at this juncture that while the exemplary embodiments of the invention as described above make use of at least a pair of barbed prongs, each of which includes two barbs that is merely exemplary. Thus, any impaling clip constructed in accordance with this invention can include any number of barbed prongs, with the number of barbs thereon being selected for the type panel to be supported by the impaling clip and the thickness of that panel. Moreover, the shape, cross-section and size of the prongs can be different than that shown and described above, so long as each prong is barbed to be resistant to removal from within the interior of the panel once it pierces into the interior of the panel. The length of the prongs will depend upon the thickness of the acoustic panel to be mounted. Thus, for mounting an acoustic panel which is approximately 1 inch in thickness, the prongs should be less than 1 inch so that the pointed free end does not extend out through the outer surface 10B of the panel 10. The maximum width of the either the head portion or any of its subsidiary points will also depend upon the thickness and weight and composition of the panel to be mounted thereby. Without further elaboration the foregoing will so fully illustrate my invention that others may, by applying current or future knowledge, adopt the same for use under various conditions of service.

I claim:

1. An impaling clip for mounting a panel on a support structure, the panel being formed of a material having a rear surface and a front surface, said clip comprising:

a base including an undersurface configured to be disposed on an outer surface of the support structure and an face surface located opposite said undersurface, said base having a peripheral edge, a center and at least two windows spaced from each other on opposite sides of said center, each of said at least two windows having a central longitudinal axis;

a group of prongs comprising a first prong, a second prong, a third prong, and a fourth prong, said group of prongs being located between said center and said peripheral edge, and with said base being devoid of any other prongs between said group of prongs and said peripheral edge, each of said prongs of said group of prongs being in the form of a planar member lying in a plane projecting outward perpendicularly from said front surface and comprising a leg portion, a sharp head portion having a free end in the form of sharp main point, and at least one subsidiary point, wherein no two prongs on one side of said center are in a coincident plane and no two prongs on the opposite side of said center are in a coincident plane, wherein said at least one subsidiary point is in the form of an undercut barb having an edge extending at an acute angle with respect to a side edge of said leg portion of said prong, said sharp main point of said prong being configured for penetration of the rear surface of the panel, whereupon said sharp main point, said at least one subsidiary point and at least a portion of said leg portion enters and is fixedly held within the material of the panel between the rear surface and the front surface thereof, with said at least one subsidiary point resisting extraction of said prong from within the material of the panel.

2. The impaling clip of claim 1, wherein two of said first, second, third and fourth prongs are in planes parallel to or coincident with each other, and wherein another two of said first, second, third and fourth prongs are in planes parallel to or coincident with each other.

3. The impaling clip of claim 2, wherein said two of said first, second, third and fourth prongs are in planes coincident with each other, wherein said another two of said first, second, third and fourth prongs are in planes coincident with each other, wherein said base comprises a first window and a second window, each of said windows having a longitudinal central axis, a first edge portion located adjacent one side of said longitudinal central axis, a second edge portion located adjacent said longitudinal central axis and opposite said first edge portion, said first edge portion being located above said second edge portion, wherein said first prong projects outward perpendicularly from said base at said first edge portion of said first window and said second prong projects outward perpendicularly from said base at said second edge portion of said first window, and wherein said third prong projects outward perpendicularly from said base at said first edge portion of said second window and said fourth prong projects outward perpendicularly from said base at said second edge portion of said second window.

4. The impaling clip of claim 3, wherein said at least one subsidiary point comprises first and second subsidiary points, each of said first and second subsidiary points being in the form of an undercut barb having an edge extending at an acute angle with respect to a respective side edge of said leg portion of said prong.

5. The impaling clip of claim 4, wherein said leg portion of each of said prongs includes a first side edge and a second side edge, and wherein said first subsidiary point is located adjacent said first side edge and said second subsidiary point is located adjacent said second side edge.

6. The impaling clip of claim 5, wherein said first and second subsidiary points are longitudinally offset from each other along an axis extending a length of said prong.

7. The impaling clip of claim 2, wherein said first and fourth prongs are in planes parallel to each other, and wherein said second and third prongs are in planes parallel to each other and perpendicular to said planes of said first and fourth prongs.

8. The impaling clip of claim 7, wherein said base comprises a first, second, third and fourth windows, each of said windows having a longitudinal central axis, a first edge portion located adjacent said longitudinal central axis, and a second edge portion located adjacent said longitudinal central axis and opposite said first edge portion, wherein said first prong projects outward perpendicularly from said base at said first edge portion of said first window, said second prong projects outward perpendicularly from said base at said first edge portion of said second window, wherein said third prong projects outward perpendicularly from said base at said first edge portion of said third window and said fourth prong projects outward perpendicularly from said base at said first edge portion of said fourth window.

9. The impaling clip of claim 8, wherein said at least one subsidiary point comprises first and second subsidiary points, each of said first and second subsidiary points being in the form of an undercut barb having an edge extending at an acute angle with respect to a respective side edge of said leg portion of said prong.

10. The impaling clip of claim 9, wherein said leg portion of each of said prongs includes a first side edge and a second side edge, and wherein said first subsidiary point is located adjacent said first side edge and said second subsidiary point is located adjacent said second side edge.

11. The impaling clip of claim 10, wherein said first and second subsidiary points are longitudinally offset from each other along an axis extending a length of said prong.

12. The impaling clip of claim 8, additionally comprising an opening located in said base between said first window and said second window.

13. The impaling clip of claim 3, additionally comprising an opening located in said base between said first window and said second window.

14. A precursor for an impaling clip for mounting a panel on a support structure, the panel being formed of a material having a rear surface and a front surface, said precursor comprising:

a generally planar sheet comprising a base including an undersurface, a peripheral edge, and a center, said base lying in a plane;

an opening or hole extending through said sheet and configured for receipt of a fastener therethrough;

a first planar prong portion of said generally planar sheet located at a portion of said base and lying in said plane, a second planar prong portion of said generally planar sheet located at another portion of said base and lying in said plane, a third planar prong portion of said generally planar sheet located at another portion of said base and lying in said plane, and a fourth planar prong portion of said generally planar sheet located at another portion of said base and lying in said plane, each of said planar prong portions comprising a leg portion, a sharp head portion having a free end in the form of sharp main point, and at least one subsidiary point, said at least one subsidiary point being in the form of an undercut barb having an edge extending at an acute angle with respect to a side edge of said leg portion, each of said planar prong portions being configured to be bent out of said plane to an orientation perpendicular to said plane to form a group of prongs comprising respective first, second, third and fourth prongs, said group of prongs being located between said center and said peripheral edge, and with said base being devoid of any other prongs between said group of prongs and said peripheral edge, wherein no two prongs on one side of said center are in a coincident plane and no two prongs on the opposite side of said center are in a coincident plane, wherein two of said first, second, third and fourth prongs are in planes parallel to or coincident with each other, and wherein another two of said first, second, third and fourth prongs are in planes parallel to or coincident with each other.

15. The precursor of claim 14, wherein each of said planar prong portions comprises first and second subsidiary points, each of said subsidiary points of said planar prong portions being in the form of an undercut barb having an edge extending at an acute angle with respect to a respective side edge of said leg portion.

16. The precursor of claim 15, wherein said leg portion each of said planar prong portions includes a first side edge and a second side edge, and wherein said first subsidiary point is located adjacent said first side edge and said second subsidiary point is located adjacent said second side edge.

17. The precursor of claim 16, wherein said first and second subsidiary points of said planar prong portions are longitudinally offset from each other along an axis extending a length of said planar prong portion.

18. The precursor of claim 14 wherein said two of said first, second, third and fourth planar prong portions are configured to be bent into planes coincident with each other, wherein said another two of said first, second, third and fourth planar prong portions are configured to be bent into planes coincident with each other, wherein said base comprises a first window and a second window, each of said windows having a longitudinal central axis, a first edge portion located adjacent one side of said longitudinal central axis, a second edge portion located adjacent said longitudinal central axis and opposite said first edge portion, said first edge portion being located above said second edge portion, wherein said first planar prong portion is located at said first edge portion of said first window, wherein said second planar prong project portion is located at said second edge portion of said first window, wherein said third planar prong portion is located at said first edge portion of said second window, and wherein said second planar prong portion is located at said second edge portion of said second window.

19. The precursor of claim 14, wherein said first and fourth planar prong portions are configured to be bent in planes parallel to each other, and wherein said second and third planar prong portions are configured to be bent into planes parallel to each other and perpendicular to said planes of said first and fourth prong portions.

20. The precursor of claim 19, wherein said base comprises a first, second, third and fourth windows, each of said windows having a longitudinal central axis, a first edge portion located adjacent said longitudinal central axis, and a second edge portion located adjacent said longitudinal central axis and opposite said first edge portion, wherein said first planar prong portion is located at said first edge portion of said first window, said second planar prong portion is located at said first edge portion of said second window, wherein said third planar prong portion is located at said first edge portion of said third window, and wherein said fourth planar prong portion is located at said first edge portion of said fourth window.

21. A method of mounting an acoustic panel on a structural component, said acoustic panel having a front surface and a rear surface, said method comprising:

(a) providing an impaling clip comprising a base and group of prongs, said group of prongs comprising a first, second, third and fourth prongs, said base including an undersurface configured to be disposed on an outer surface of the support structure and a front surface located opposite said undersurface, said base having a peripheral edge, a center and at least two windows spaced from each other on opposite sides of said center, each of said at least two windows having a central longitudinal axis, said group of prongs being located between said center and said peripheral edge, and with said base being devoid of any other prongs between said group of prongs and said peripheral edge, each of said prongs of said group of prongs being in the form of a planar member lying in a plane projecting outward perpendicularly from said front surface, wherein no two prongs on one side of said center are in a coincident plane and no two prongs on the opposite side of said center are in a coincident plane, wherein each of said prongs a leg portion, a sharp head portion having a free end in the form of sharp main point, and at least one subsidiary point, said at least one subsidiary point of being in the form of an undercut barb having an edge extending at an acute angle with respect to a side edge of said leg portion of said prong, said sharp main point of said prong being configured for penetration of the rear surface of the panel; and (b) causing said sharp main point of said prongs to penetrate the rear surface of the panel, whereupon said sharp main point of said prongs, said at least one subsidiary point of said prongs and at least a portion of said leg portion of said prongs enter and are fixedly held within the material of the panel between the rear surface and the front surface thereof, with said at least one subsidiary point of said prongs resisting extraction of said prongs from within the material of the panel.

22. The method of claim 21, wherein said method additionally comprises:

(c) disposing said undersurface of said base on an outer surface of the support structure; and (d) extending a fastening member through said at least one opening to fixedly secure said base on the support structure with said undersurface in engagement with the outer surface of the support structure.

23. The method of claim 21, wherein said acoustic panel is formed of a polyester material.

* * * * *